US010792831B2

(12) United States Patent
Ascari et al.

(10) Patent No.: US 10,792,831 B2
(45) Date of Patent: Oct. 6, 2020

(54) MACHINE FOR CUTTING FRUIT OR VEGETABLES INTO SEGMENTS

(71) Applicant: A.B.L. S.P.A., Cavezzo (Modena) (IT)

(72) Inventors: Carlo Ascari, Cavezzo (IT); Luca Ascari, Cavezzo (IT)

(73) Assignee: A.B.L. S.R.L., Cavezzo (IT)

( * ) Notice: Subject to any disclaimer, the term of this patent is extended or adjusted under 35 U.S.C. 154(b) by 11 days.

(21) Appl. No.: 15/912,158

(22) Filed: Mar. 5, 2018

(65) Prior Publication Data

US 2018/0264672 A1 Sep. 20, 2018

(30) Foreign Application Priority Data

Mar. 16, 2017 (IT) ..... 102017000029195

(51) Int. Cl.

| | |
|---|---|
| ***B26D 3/26*** | (2006.01) |
| ***B26D 7/06*** | (2006.01) |
| ***B26D 3/18*** | (2006.01) |
| ***B26D 3/24*** | (2006.01) |
| ***B26D 1/02*** | (2006.01) |
| ***B26D 5/00*** | (2006.01) |
| ***B26D 7/00*** | (2006.01) |

(52) U.S. Cl.

CPC ..... *B26D 3/26* (2013.01); *B26D 1/02* (2013.01); *B26D 3/185* (2013.01); *B26D 3/24* (2013.01); *B26D 5/00* (2013.01); *B26D 7/0608* (2013.01); *B26D 2007/0043* (2013.01); *Y10T 83/6481* (2015.04); *Y10T 83/8785* (2015.04); *Y10T 83/8831* (2015.04); *Y10T 83/9495* (2015.04)

(58) Field of Classification Search

CPC ..... B26D 3/24; B26D 3/26; B26D 7/0608; B26D 2001/006; Y10T 83/6614; Y10T 83/6588; Y10T 83/885; Y10T 83/662; Y10T 83/8785; Y10T 83/6481; Y10T 83/6616; Y10T 83/6617; Y10T 83/6619; Y10T 83/9495; A23N 4/14

USPC ..... 83/620, 857, 435.15–435.19; 30/114, 30/302, 303; 99/537, 538, 545, 543

See application file for complete search history.

(56) References Cited

U.S. PATENT DOCUMENTS 2,097,170 A * 10/1937 Wilson ..... A23N 4/14 99/543
2,373,781 A * 4/1945 Richardson ..... B26D 3/185 100/226
3,696,847 A * 10/1972 Erekson ..... A23N 4/14 99/545

(Continued)

FOREIGN PATENT DOCUMENTS

CN 205852869 U 1/2017
DE 102004002070 A1 8/2005

*Primary Examiner* — Laura M Lee
(74) *Attorney, Agent, or Firm* — Pearne & Gordon LLP

(57) ABSTRACT

A machine for cutting fruit or vegetables into segments, including a blade group (10), at least one of which is arranged with a radial orientation relative to a central axis (X); a presser (20) arranged above the blade group (10) and mobile according to an operating stroke along which it pushes a product (P) through the blades (10); a motor, connected to the presser (20) for activating it along an operating stroke thereof. The presser (20) includes a central body (21), connected to the motor; a peripheral body (22), arranged concentrically to the central body (21) and mobile relative to the central body (21) between a first and a second end position.

15 Claims, 3 Drawing Sheets

(56) References Cited

U.S. PATENT DOCUMENTS

| | | | | | |
|---|---|---|---|---|---|
| 4,216,712 | A * | 8/1980 | Altman | A23N 4/18 | 99/544 |
| 4,453,458 | A * | 6/1984 | Altman | A23N 15/003 | 99/544 |
| 4,917,007 | A * | 4/1990 | Nelson | A23N 1/003 | 100/108 |
| 5,060,563 | A * | 10/1991 | Plant | A23N 15/06 | 408/37 |
| 5,373,781 | A * | 12/1994 | Knasel | A23N 4/20 | 99/542 |
| 5,463,943 | A * | 11/1995 | Knasel | A23N 4/20 | 99/542 |
| 6,318,225 | B1 * | 11/2001 | Longoria | A21C 11/10 | 30/114 |
| 6,799,496 | B2 * | 10/2004 | Verhaeghe | B26D 1/553 | 83/167 |
| 7,086,155 | B2 * | 8/2006 | Chan | A47J 9/005 | 30/114 |
| 7,185,583 | B2 * | 3/2007 | Berglin | A23N 4/14 | 426/484 |
| 7,568,414 | B2 * | 8/2009 | Farid | B26D 3/26 | 30/114 |
| 2009/0007804 | A1 * | 1/2009 | Heck | A23N 7/08 | 99/543 |
| 2009/0193952 | A1 | 8/2009 | Farid et al. | | |

* cited by examiner

MACHINE FOR CUTTING FRUIT OR VEGETABLES INTO SEGMENTS

The subject matter of the present invention is a machine for cutting fruit or vegetables into segments.

The machine according to the present invention can be used for cutting round fruits, e.g. apples, apricots and peaches, into segments, but not exclusively.

The machines currently available substantially comprise a group of blades arranged radially according to the number of segments to be obtained. In a central position with respect to the radial blades, a tubular blade is also arranged, intended to remove the central part of the fruit containing the core or the stones.

The blade group described above is located on an opening through which the cut segments and the part removed by the tubular blade fall. The cut is obtained by means of an upper presser which, by performing a predefined stroke in the downwards direction, presses the fruit onto the blades so that they cross it completely. For that purpose, the upper presser has a series of radial notches that copy the arrangement of the radial blades and are intended to be inserted on the latter to push the fruit through the blades.

In the machines currently available the upper presser is substantially a rigid body that applies pressure on the fruit that must be sufficient to allow the entire fruit to be cut, including the central part which, normally, requires greater pressure with respect to the others, due to the presence of the core and/or the stone. The parts surrounding the central part of the fruit are therefore subject to greater pressure than that which is effectively required, and are often damaged or bruised unacceptably, quickly turning black. This compromises the quality and the shelf-life of the segments obtained.

The aim of the present invention is to provide a machine which enables the drawbacks of the currently available machines to be obviated.

An advantage of the machine according to the present invention is that it drastically reduces the pressure exerted on the zones surrounding the central part of the fruit, preventing damage and deterioration thereto.

Another advantage of the machine according to the present invention is that it allows any incorrect positioning of the fruit or a decentered position of the stone to be detected, preventing any damage to the blades.

Further characteristics and advantages of the present invention will become more apparent in the following detailed description of an embodiment of the present invention, illustrated by way of non-limiting example in the attached figures, in which.

Figure 1:
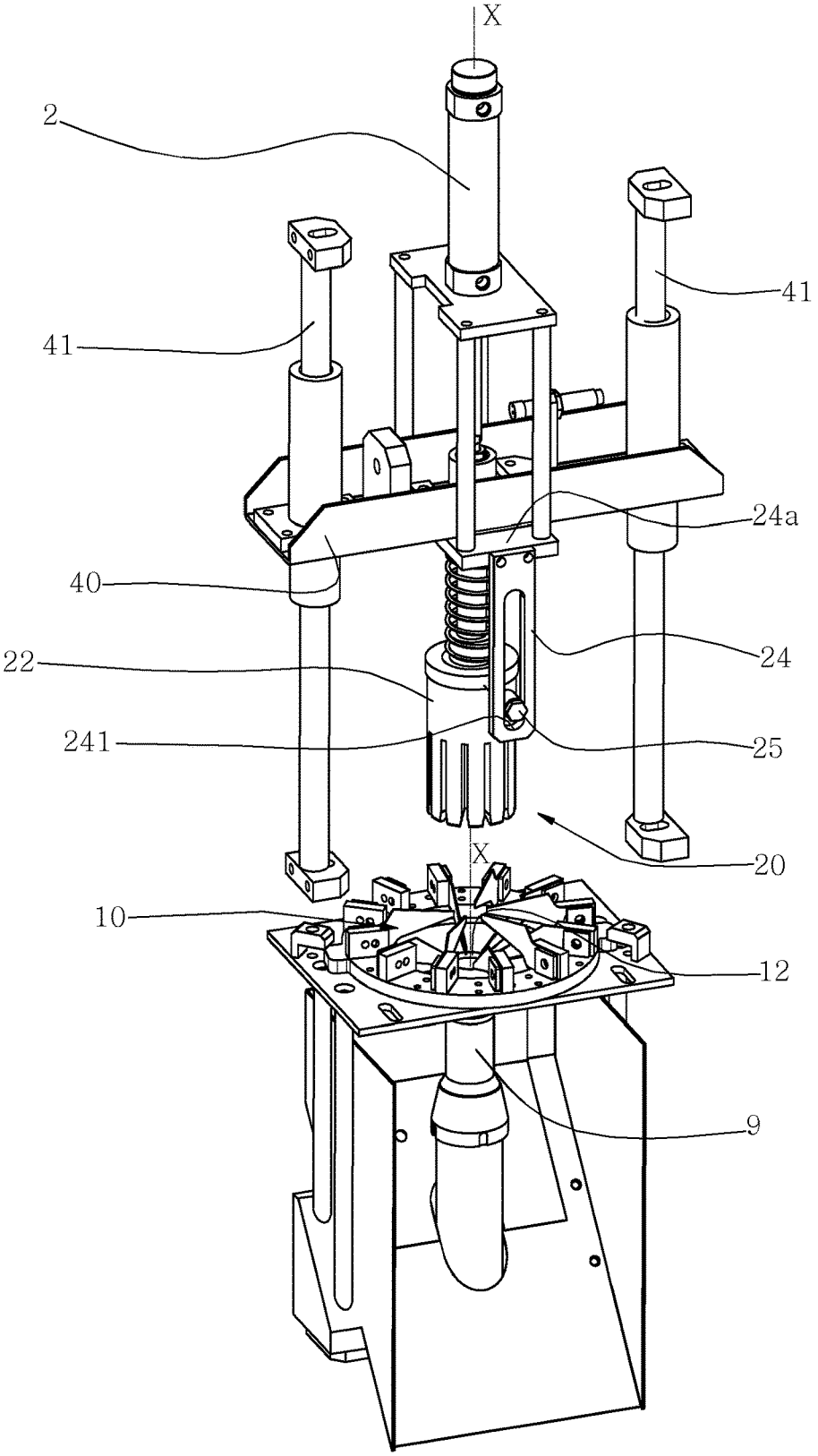
FIG. 1 shows an axonometric view of the machine according to the present invention.
Figure 2:
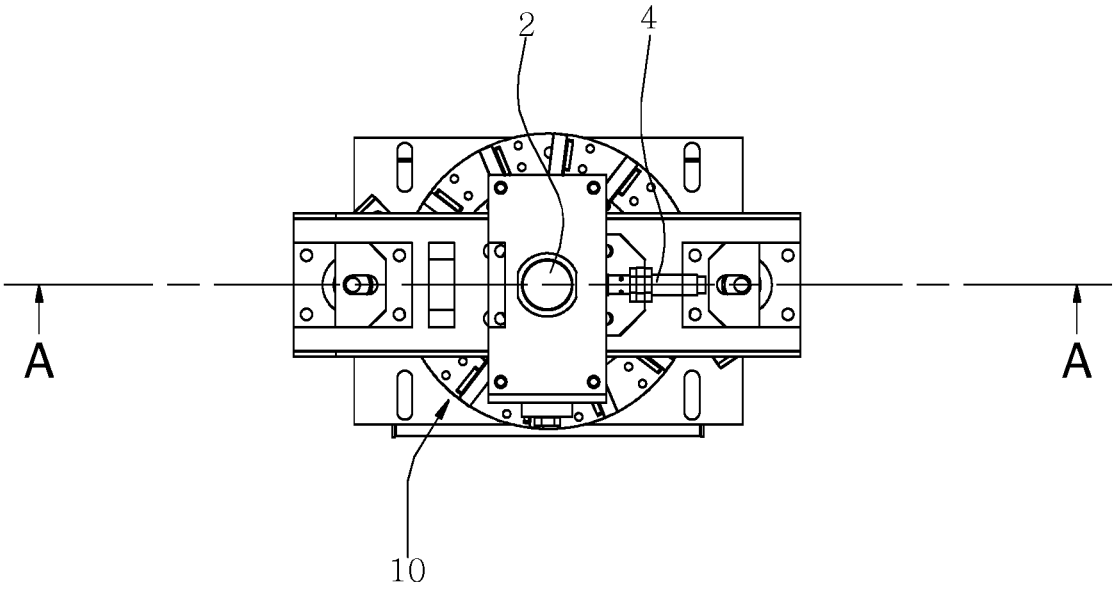
FIG. 2 illustrates a view from above of the machine of FIG. 1.
Figure 3:
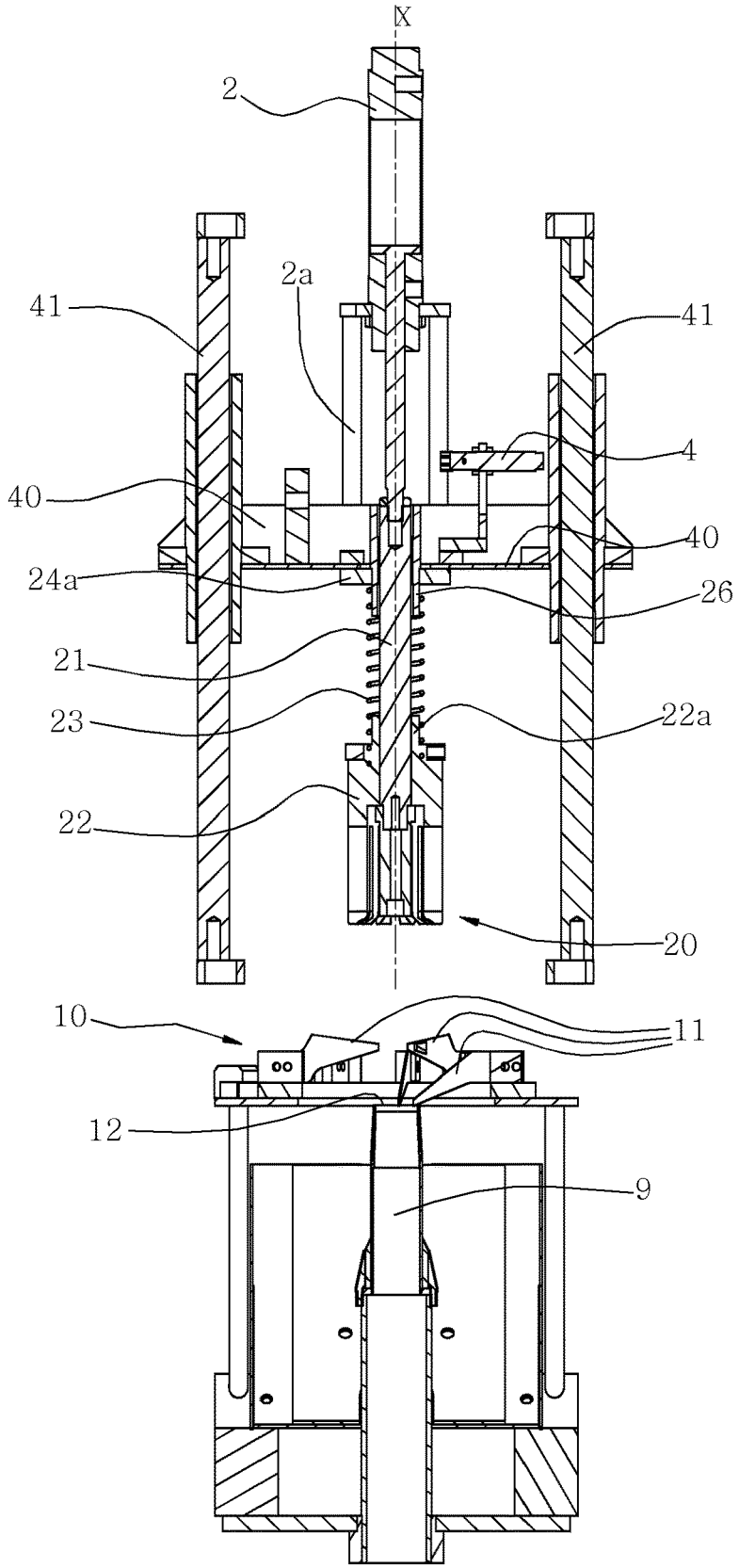
FIG. 3 shows a sectional view taken along line A-A of FIG. 2.

The machine according to the present invention comprises a blade group (10), structured to perform the cutting of the product into segments and to remove a central portion thereof. For that purpose, at least one of the blades (11) is arranged with a radial orientation with respect to a central axis (X). A tubular blade (12) is also arranged concentrically to the central axis (X) for removing the central portion of the product.

With reference to the positioning of the machine in which the central axis (X) is vertical, the blades (10) are arranged above an opening through which the segments of fruit fall. The tubular blade is instead connected to a separate channel (9) that leads the central portion of the fruit towards a separate destination from the segments.

As shown in FIG. 1, the radial blades (11) are arranged with the sharp part facing upwards. Each sharp part is also tilted downwards in the direction of the central axis (X). The tilt of the sharp parts may be different among the various blades. For example, in the solution shown, some radial blades (11) with a lesser tilt are alternating with other radial blades (11) with a greater tilt. This allows the cutting of the segments to be more gradual, reducing the pressure necessary for making the cut.

A presser (20) is arranged above the blade group (10) and is mobile forwards and backwards according to an operating stroke. During the forward stroke the presser (20) pushes the product through the blades (10). The operating stroke of the presser (20) extends between an initial position and a final position. In relation to the vertical orientation shown in the figures, the initial position of the presser (2) is higher than the final position. While the presser (20) is in the initial or higher position, a product can be arranged resting on the blades (10), through a manipulator not shown in the figures. From the upper position the presser (20) descends towards the final or lower position, pushing the product against the blades (10) which perform the cut thereof.

A motor means (not illustrated as known to a person skilled in the art) is connected to the presser (20) for activating it along the operating stroke thereof. For example, the motor means comprises one or more pneumatic cylinders.

Preferably, but not necessarily, the presser (20) is associated with a mobile structure (40) comprising, for example, a cross member being slidable along guides (41) which, in the embodiment shown, are oriented vertically. The mobile structure (40) can translate along the guides (41) by means of the motor means not illustrated.

In the machine according to the present invention, the presser (20) comprises a central body (21), connected to the motor means through the mobile structure (40). The central body (21) is concentric to the central axis (X) and is intended to exert a thrust on the central zone of the product. In the lower position of the presser (20), the central body (21) is arranged in proximity to the tubular blade (12) or is partially inserted therein.

The presser (20) further comprises a peripheral body (22), arranged concentrically to the central body (21). In substance, the peripheral body (22) surrounds the central body (22), so as to come into contact with the peripheral part of the product, i.e. the part which is external to the central part. The function of the peripheral body (22) is substantially that of pushing onto the blades (10) the peripheral part of the product, i.e. the external part to the central part.

For that purpose, the peripheral body (22) is equipped with a plurality of radial notches, intended to be inserted on the radial blades (11). In this way, the portions of the peripheral body (22) that can be found between the radial notches can slide between the radial blades (11), also to push the product completely through the radial blades (11).

The peripheral body (22) is deconstrained with respect to the central body (21), i.e. the peripheral body (22) is not rigidly connected to the central body (21). This means that the thrust exerted by the central body (21) on the central part of the product is not transferred directly to the external part of the product, rather it can be transmitted indirectly and, for example, in a gradual or reduced manner.

In substance, a larger force, sufficient to remove the core or the stone from the product, can be transmitted to the central part of the product by means of the central body (21).

A smaller force can, instead, be transmitted to the external part of the product, by means of the peripheral body (22). In this way, the external part of the product, i.e. the part intended to be transformed into segments, can be subject to a significantly lower pressure with respect to what happens in currently available machines.

In the embodiment shown, the peripheral body (22) is mobile relative to the central body (21) between an advanced position and a retracted position. In the advanced position the peripheral body (22) and the central body (21) are in a rest configuration which precedes contact with the product. For example, in the advanced position the central body (21) is arranged with its lower end aligned or near to a lower end of the peripheral body (22).

When the presser (20) comes into contact with the product, the central body (21), which is connected to the motor means through the mobile structure (40), substantially performs the same stroke as the mobile structure (40). The peripheral body (22), which is deconstrained from the central body (21), slows down or halts in contact with the product, at least in an initial step of the descent of the presser (20), assuming its retracted position, thus reducing the thrust exerted on the part of product with which it comes into contact. In the embodiment shown, when the peripheral body (22) is in its retracted position the central body (21) is projected further downwards with respect to the peripheral body (22).

A pusher means (23) is provided to act on the peripheral body (22) and to push it towards the advanced position. In the embodiment represented, the pusher means (23) pushes the peripheral body (22) downwards. The thrust exerted by the means (23) may be adjusted to an intensity sufficient to allow the external part of the product to be cut into segments. Such intensity, as already underlined, is substantially lower than the intensity required for cutting the central part of the product, which is transmitted to the central body (21) by the motor means.

Preferably the pusher means (23) comprises an elastic means or a spring, e.g. operating under pressure. The use of an elastic means allows the thrust on the peripheral body (22) to be adjusted, also in relation to the shortening or lengthening imposed on the elastic means itself.

In the embodiment represented, the pusher means (23) is interposed between the peripheral body (22) and the central body (21). In this way, the thrust transmitted by the motor means to the central body (21) is also transmitted to the peripheral body (22), and is mediated by the action of the pusher means (23).

In particular, in the solution represented the elastic pusher means (23) begins to be compressed once the peripheral body (22) descending downwards together with the central body (21), comes into contact with the product. The force transmitted to the peripheral body (22) is therefore initially lower, and increases as the stroke of the central body (21) progresses downwards, which produces the gradual compression of the pusher means (23). The force transmitted to the peripheral body (22) increases gradually until it reaches a sufficient intensity for cutting the product. Once such intensity has been reached, significantly lower than the force transmitted by the motor means to the central body (21), the peripheral body (22) begins to descend downwards, pushing the product along the blades (10). Due to the presence of the elastic pusher means (23), the force transmitted by the motor means to the peripheral body (22), and therefore to the product, will oscillate in an interval determined by the force required to perform the cut of the product on the blades (10).

In the embodiment shown, the peripheral body (22) is slidable relative to the central body (21) along the central axis (X). Preferably, the central body (21) is associated with a guide (24). In particular, such guide (24) is solidly constrained to a plate (24*a*) in turn associated with the central body (21). The peripheral body (22) comprises an appendage (25) that is slidable along the guide (24) so as to enable the relative sliding between the peripheral body (22) and the central body (21). The appendage (25) is for example in the form of a stem that projects laterally to the peripheral body (22) along a radial direction.

The guide (24) is provided with an end stop (241) that defines the first position of the peripheral body (22). Preferably, the guide (24) comprises at least a first end (241) with which the appendage (25) goes into contact in the first position of the peripheral body (22), as shown in FIG. 1. In substance, due to the effect of the action of the pusher means (23), the peripheral body (22) is arranged in the first position, i.e. with the appendage (25) in contact with the first end (241) of the guide (24).

In the embodiment represented, the pusher means (23) of the elastic type comprises a spring, interposed between the peripheral body (22) and the mobile structure (40). In particular, the spring (23) is compressed between a shank (22*a*) of the peripheral body (22) and a bushing (26) solidly constrained to the mobile structure (40). The shank (22*a*) and the bushing (26) are structured to maintain the spring (23) concentric to the central axis (X).

The machine according to the present invention can be equipped with a safety means to prevent the central body (21) being subjected to a greater axial force than a predetermined value. The central body (21), in presence of the safety means, is elastically slidable relative to the mobile structure (40). For that purpose, the safety means comprises an elastic actuator (2), interposed between the mobile structure (40) and the central body (21) and provided to push the central body (21) downwards, or however in the advancement direction of the stroke in which the product is cut. For example, the elastic actuator (2) comprises a pneumatic cylinder whose stem is connected to the central body (21). A control module for controlling the machine, e.g. an electronic processor, adjusts the pressure present inside the cylinder so that the latter exerts a predetermined force on the central body (21). The elastic actuator (2) is connected to the mobile structure (40) by means of a frame (2*a*).

A detector (4), which sends its signal to the machine's control module, is predisposed for detecting the position of the central body (21) relative to structure mobile (40). For that purpose, the detector (4) is solidly constrained to the mobile structure (40).

The machine's control module is equipped with a control algorithm which, in the case where the signal of the detector (4) indicates a determined position of the central body (21), halts the functioning of the motor means. For example, the detector (4) may be located so as to detect the excessive retraction of the central body (21) relative to the mobile structure (40) during the descent, i.e. a displacement that exceeds a predetermined threshold value. Such excessive displacement can occur in the case where the stone of the product is in a decentered position and is not completely arranged inside the tubular blade (12). In this circumstance, the stone is interposed between the tubular blade (12) and the central body (21), transmitting a force both to the tubular blade (12) and to the central body (21). If such force exceeds the force transmitted by the elastic actuator (2) to the central body (21), the latter stops, while the mobile structure (40) continues its stroke. In that case, the detector (4) identifies the halt of the central body (21), i.e. it detects the relative displacement between the central body (21) and the mobile structure (40), and sends a corresponding signal to the control module which halts the motor means, thus preventing any possible damage to the tubular blade (12) and/or the central body (21).

Advantageously, two or more machines according to the present invention can be placed adjacent to each other along an alignment direction, in order to be able to work simultaneously on several products.

The invention claimed is:

1. A machine for cutting fruit or vegetables into segments, comprising:

a blade group (10), structured to perform the cutting of the product into cut segments and to remove a first or central portion thereof, which comprises radial blades (11), arranged with a radial orientation with respect to a central axis (X), and a tubular blade (12), arranged concentrically to the central axis (X) for removing the central portion of the product;

a presser (20), equipped with a plurality of radial notches, intended to be inserted on the radial blades (11), which is arranged above the blade group (10) and is mobile according to an operating stroke along which the presser (20) pushes a product (P) through the radial blades (11);

motor means, connected to the presser (20) by means of a mobile structure (40), predisposed for activating along an operating stroke thereof;

characterised in that the presser (20) comprises:

a central body (21), connected to the motor means;

a peripheral body (22), arranged concentrically to the central body (21) and mobile relative to the central body (21);

pusher means (23) acting on the peripheral body (22) for pushing the peripheral body (22) downwardly;

wherein the pusher means (23) comprises a spring; wherein during the operating stroke: (a) the central body (21) pushes the product (P) with a first pressure sufficient to push the first or central portion of the product (P) through the tubular blade (12), and (b) the peripheral body (22) pushes a second portion of the product (P) surrounding the central portion through the radial blades (11) with a second pressure which is less than the first pressure and which is effective to minimize damage to the segments cut from the second portion and which yields intact cut segments, wherein, during the cutting of the segments from each other and from the central portion of the product (P), the peripheral body (22) is not rigidly connected to the central body (21), and wherein, during at least a portion of the cutting of the segments from each other and from the central portion of the product (P), the central body (21) advances downwardly more quickly than the peripheral body (22).

2. The machine according to claim 1, wherein the peripheral body (22) is mobile relative to the central body (21) between an advanced position and a retracted position.

3. The machine according to claim 1, wherein the pusher means (23) are interposed between the mobile structure (40) and the peripheral body (22).

4. The machine according to claim 1, wherein: the central body (21) is constrained to a guide (24); the peripheral body (22) comprises an appendage (25) that is slidable along the guide (24) so as to enable the relative sliding between the peripheral body (22) and the central body (21) along a predetermined sliding direction.

5. The machine according to claim 4, wherein the guide (24) comprises at least a first end (241) which the appendage (25) contacts in a first end position of the peripheral body (22).

6. The machine according to claim 1, wherein the central body (21) is mobile relative to the mobile structure (40), and wherein a detector (4) is predisposed for detecting the position of the central body (21) relative to the mobile structure (40).

7. The machine according to claim 6, comprising a control module, destined to control the functioning of the motor means, which control module receives a signal of the detector (4) and, in a case where the signal of the detector (4) indicates a determined position of the central body (21) with respect to the mobile structure (40), halts the functioning of the motor means.

8. The machine according to claim 1, wherein the central body (21) and the peripheral body (22) are mobile along the central axis (X).

9. The machine according to claim 1, wherein each radial blade (11) is arranged with a sharp part facing upwards, wherein each sharp part is tilted downwards in a direction of the central axis (X).

10. The machine according to claim 9, wherein sharp parts of some blades are tilted more than sharp parts of other blades.

11. The machine according to claim 10, wherein sharp parts with lesser tilt are alternating with sharp parts with greater tilt.

12. The machine according to claim 1, wherein, during the cutting of the segments from each other and from the central portion of the product (P), the central body (21) moves independently with respect to the peripheral body (22).

13. The machine according to claim 12, wherein the central body (21), moving independently with respect to the peripheral body (22), forces the central portion of the product (P) at least partially through the tubular blade (12) while the peripheral body (22) forces the second portion of the product (P) at least partially through the radial blades (11).

14. The machine according to claim 1, wherein the central body (21) is moved by said motor means and the same motor means moves the peripheral body (22).

15. The machine according to claim 1, wherein the spring is arranged concentrically to the central body (21).

* * * * *